United States Patent [19]

Doolittle

[11] 4,003,523

[45] Jan. 18, 1977

[54] PORTABLE PILL GRINDER

[76] Inventor: Harry S. Doolittle, 19 Concord Lane, Wallingford, Conn. 06492

[22] Filed: July 23, 1975

[21] Appl. No.: 598,431

Related U.S. Application Data

[63] Continuation-in-part of Ser. No. 509,421, Sept. 26, 1974, abandoned, which is a continuation of Ser. No. 353,939, April 24, 1973, abandoned.

[52] U.S. Cl. ..... 241/169.2; 241/199.9; 241/DIG. 27

[51] Int. Cl.[2] ..... B02C 19/08

[58] Field of Search ..... 241/168, 169, 169.1, 241/169.2, 199, 199.9, 199.11, DIG. 27

[56] References Cited

UNITED STATES PATENTS

| | | | |
|---|---|---|---|
| 1,712,802 | 5/1929 | Willis | 241/168 X |
| 2,602,596 | 2/1952 | Jones | 241/199 X |
| 2,631,786 | 3/1953 | Morgan et al. | 241/DIG. 27 |
| 3,915,393 | 10/1975 | Elkins | 241/DIG. 27 |

FOREIGN PATENTS OR APPLICATIONS

| | | | |
|---|---|---|---|
| 1,001,879 | 1/1957 | Germany | 241/199 |
| 328,801 | 5/1930 | United Kingdom | 241/199 |

*Primary Examiner*—Granville Y. Custer, Jr.
*Assistant Examiner*—Howard N. Goldberg
*Attorney, Agent, or Firm*—McCormick, Paulding & Huber

[57] ABSTRACT

A portable pill grinder comprising ceramic mortar and pestle units respectively having concave and convex pill crushing and grinding surfaces. Lower and upper clamping handles respectively support the mortar and pestle units and are pivotally connected together at adjacent end portions. The mortar and lower handle have cooperating grooves and upstanding flanges which prevent relative rotation therebetween. The pestle is supported for rotation about a short lug on the upper handle and has a laterally projecting handle for rotating the same. A stop is provided between the clamping handles to prevent crushing the mortar and pestle units. In use, the clamping handles are grasped in one hand, pressure is applied tending to crush one or more pills disposed in the mortar and engaged by the pestle, and the pestle handle is simultaneously swung back and forth with the other hand to effect a grinding action on the pills. In a second embodiment the pestle is stationary and the mortar is of two piece construction with one piece thereof provided with a handle and swingable back and forth in a pill grinding action.

17 Claims, 10 Drawing Figures

FIG. 8
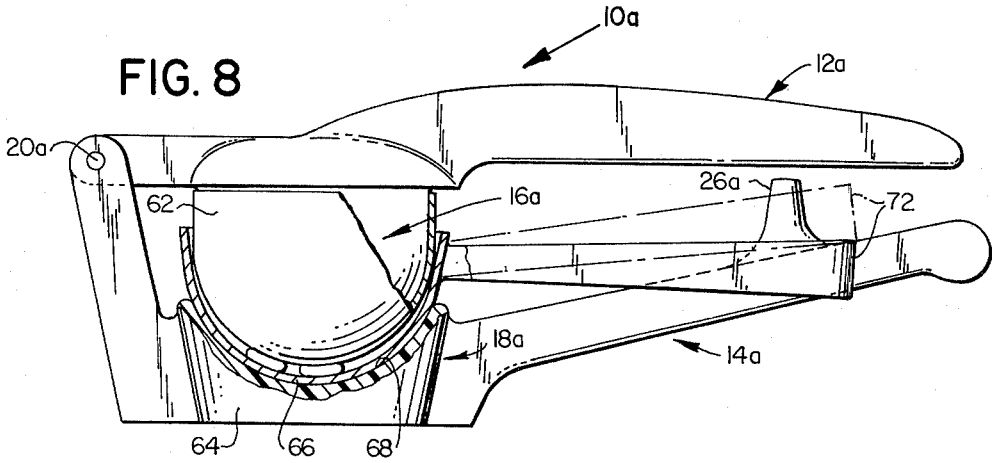
FIG. 9
FIG. 10
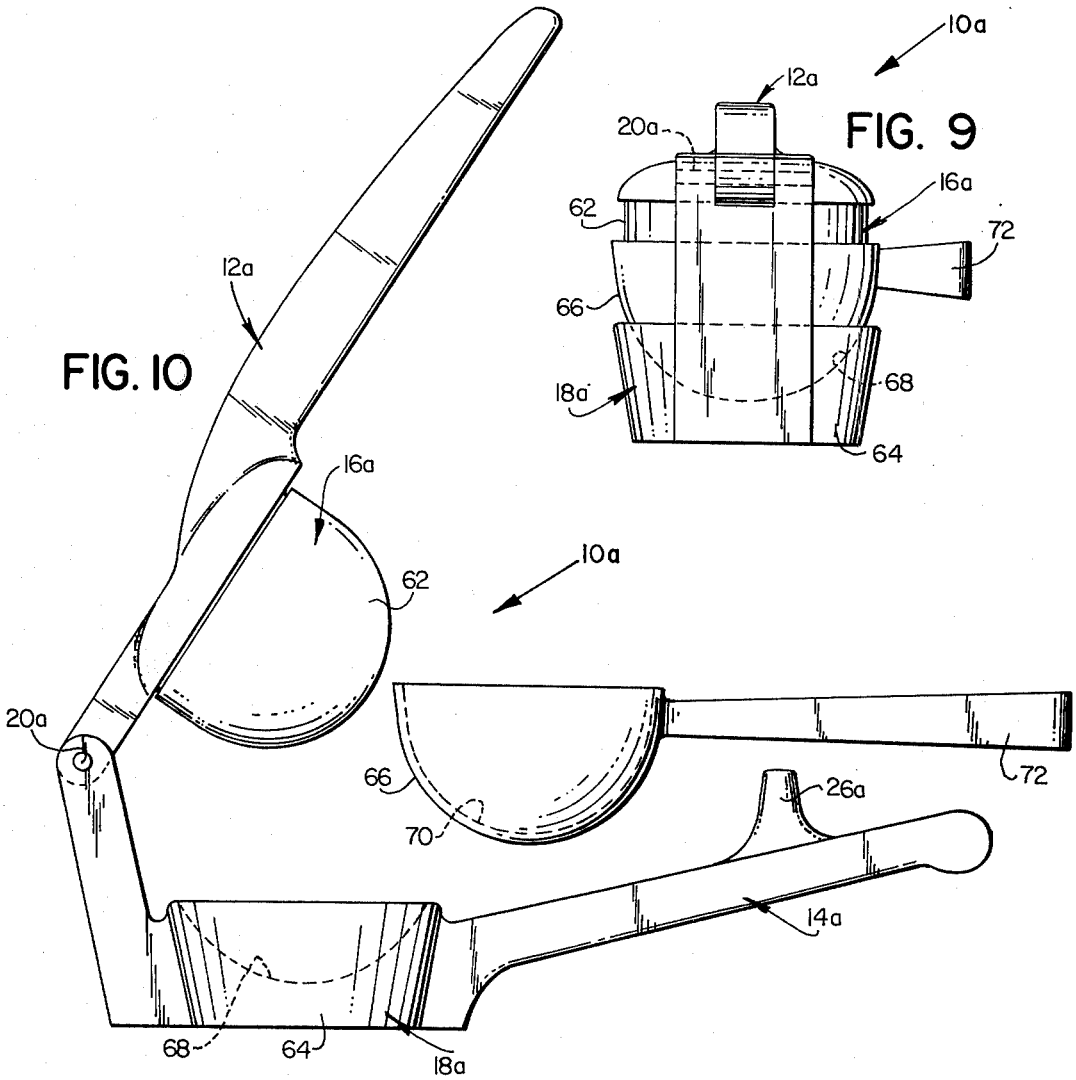

PORTABLE PILL GRINDER

RELATED APPLICATIONS

This application is a continuation-in-part of application Ser. No. 509,421, filed Sept. 26, 1974, now abandoned Portable Pill Grinder, in turn a continuation of application Ser. No. 353,939, filed Apr. 24, 1973, Portable Pill Grinder, now abandoned.

BACKGROUND OF THE INVENTION

Mortar and pestle units of various designs have heretofore been available but have not been readily and conveniently portable. For example, in the bedside grinding of pills in hospitals, it is a common practice for nurses to use two spoons for this purpose, a somewhat inefficient expedient. Moreover, a substantial percentage of patients require pill grinding, this including the young, the elderly and those who simply cannot swallow pills whole.

SUMMARY OF INVENTION

It is the general object of the present invention to provide a portable pill grinder which is light in weight, of desirably simple and economic construction, and easily manipulated in use.

BRIEF DESCRIPTION OF THE DRAWINGS

FIG. 8 is a side elevational view partially in section of a portable pill grinder forming a second embodiment of the present invention.

FIG. 9 is a front end view of the portable pill grinder of FIG. 8.

FIG. 10 is a side elevational view similar to FIG. 8 but with the grinder in an open and partially separated condition.

DETAILED DESCRIPTION OF PREFERRED EMBODIMENTS

Figure 1:
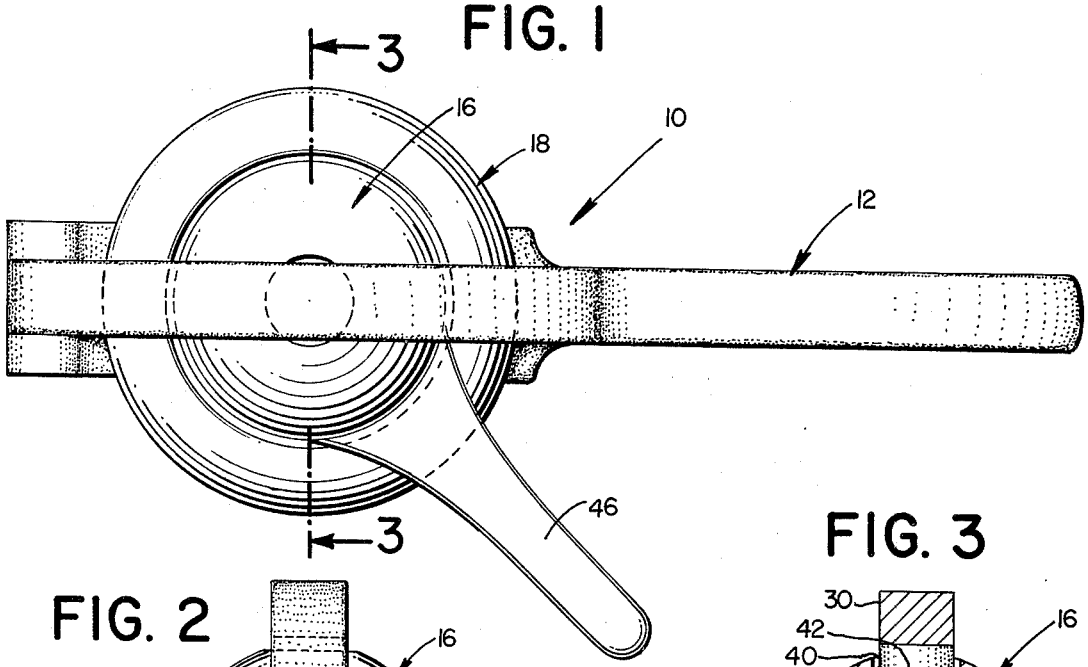
FIG. 1 is a top view of the portable pill grinder of the present invention.
Figure 2:
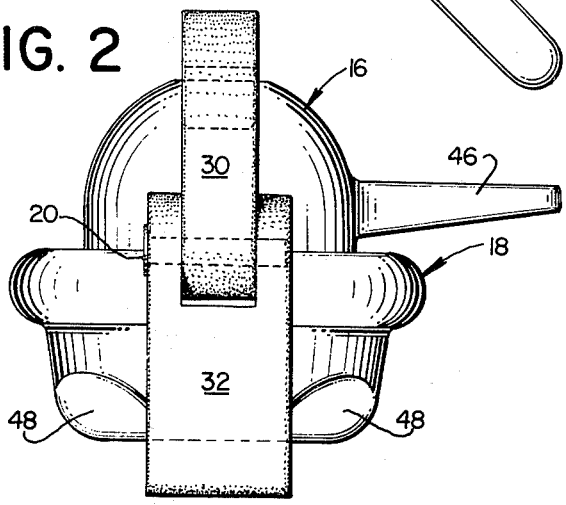
FIG. 2 is a front end view of the pill grinder.

Referring particularly to FIGS. 1–4, it will be observed that a portable pill crushing and grinding device, indicated generally therein at 10, comprises upper and lower clamping handles 12 and 14 and a pestle unit 16 and mortar unit 18. In accordance with the invention, the upper handle 12 and the pestle unit 16 may be formed integrally or as separate parts in the manner shown. Similarly, the lower handle 14 and the mortar unit 18 may be of integral construction or may be formed in separate and independent parts. As shown, the clamping handles 12, 14 are pivotally connected at adjoining end portions by means of a suitable pivot pin 20. Opposite end portions of the handles indicated respectively at 22, 24 are adapted to be manually manipulated and, more specifically, to be grasped in one hand of the nurse or other operator of the device. A stop is preferably provided to prevent crushing of the mortar and pestle units and is shown in the form of an upstanding lug 26 formed on the lower handle portion 24. An upper surface 28 of a lug 26 engages a lower surface of the upper handle 12 to limit the closing action of the handles.

Intermediate portions of the handles 12, 14 indicated generally at 30, 32 are formed to accommodate and to mount the mortar and pestle units of the present invention. As will be explained more fully hereinbelow, the mortar and pestle units are adapted for relative rotation and at least one of said units has a rotating handle which may be grasped by a nurse or other operator with a free or other hand while said one hand is grasping the clamping handles 12, 14. In the embodiment shown in FIGS. 1–7, the pestle 16 is adapted for relative rotation with respect to its handle 12 and the mortar 18 is fixed in relationship to its handle 14.

Figure 3:
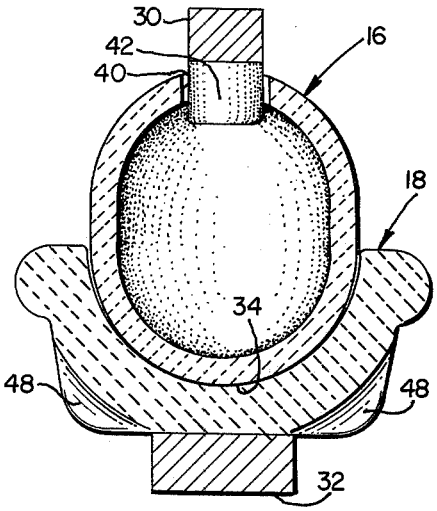
FIG. 3 is a transverse vertical section taken generally as indicated at 3—3 in FIG. 1.
Figure 4:
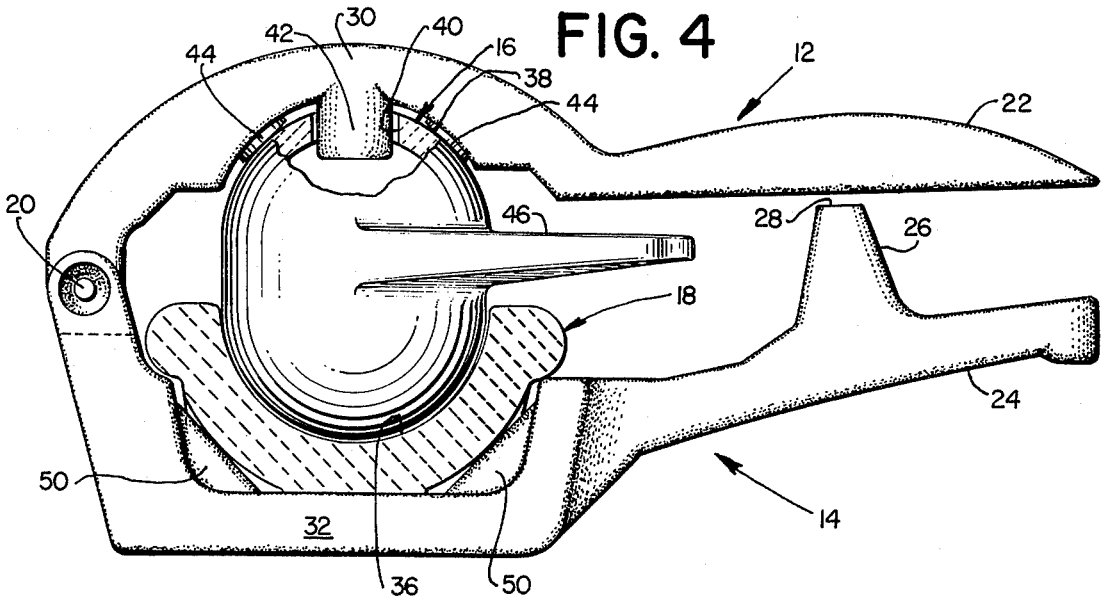
FIG. 4 is a side elevation with selected parts shown partially in section.

Referring now particularly to FIGS. 3 and 4, it will be observed that the pestle and mortar units 16, 18 are provided respectively with convex and concave crushing and grinding surfaces 34, 36 of smooth, hard and impervious material. The said surfaces are complementary and are relatively rotatable about a common vertical axis passing through the centers thereof. As shown, the pestle unit 16 is formed in a hollow configuration with an upper portion 38 thereof identical with the lower portion 34 except for the provision of a circular opening 40 facing upwardly at a top portion thereof. The opening 40 receives a small cylindrical lug 42 formed on the intermediate portion 30 of the upper handle 12. Further, there is preferably provided a means for reducing friction and for enhancing the ease of rotation of the pestle unit 16 in the form of small anti-friction pads 44,44. The pestle unit 16 carries a laterally extending and integrally formed rotating handle 46 which may be readily grasped by the user and swung in a back and forth motion through a limited angular displacement whereby to effect relative rotation between the pestle unit 16, the handle 12 and the mortar unit 18. As shown, the lug 42 freely enters the opening 40 and guides the pestle unit 16 during back and forth swinging movement or limited angular rotation of the unit. It is also within the scope of the invention to provide a lug arrangement adapted to releasably hold the pestle unit in position when the upper handle 12 is raised as illustrated in FIG. 5.

The mortar unit 18 is conventional in shape and has four generally radial slots or grooves 48,48 facing downwardly at lower portions thereof. The grooves 48,48 receive upstanding flanges 50,50 on the lower handle 14 at the intermediate portion 32 and side surfaces of the grooves are engaged by the flanges 50,50 to prevent rotation of the mortar unit 18 relative to the handle 14. Thus, it will be apparent that the pestle unit 16 may be swung back and forth through a limited angle to provide a rotary grinding action on one or more pills disposed in the mortar unit 18.

The materials of construction may vary widely within the scope of the present invention but it is presently preferred to employ handles of relatively light-weight construction as for example, aluminum or plastic, and to employ ceramic or stainless steel construction for the pestle and mortar units.

Figure 5:
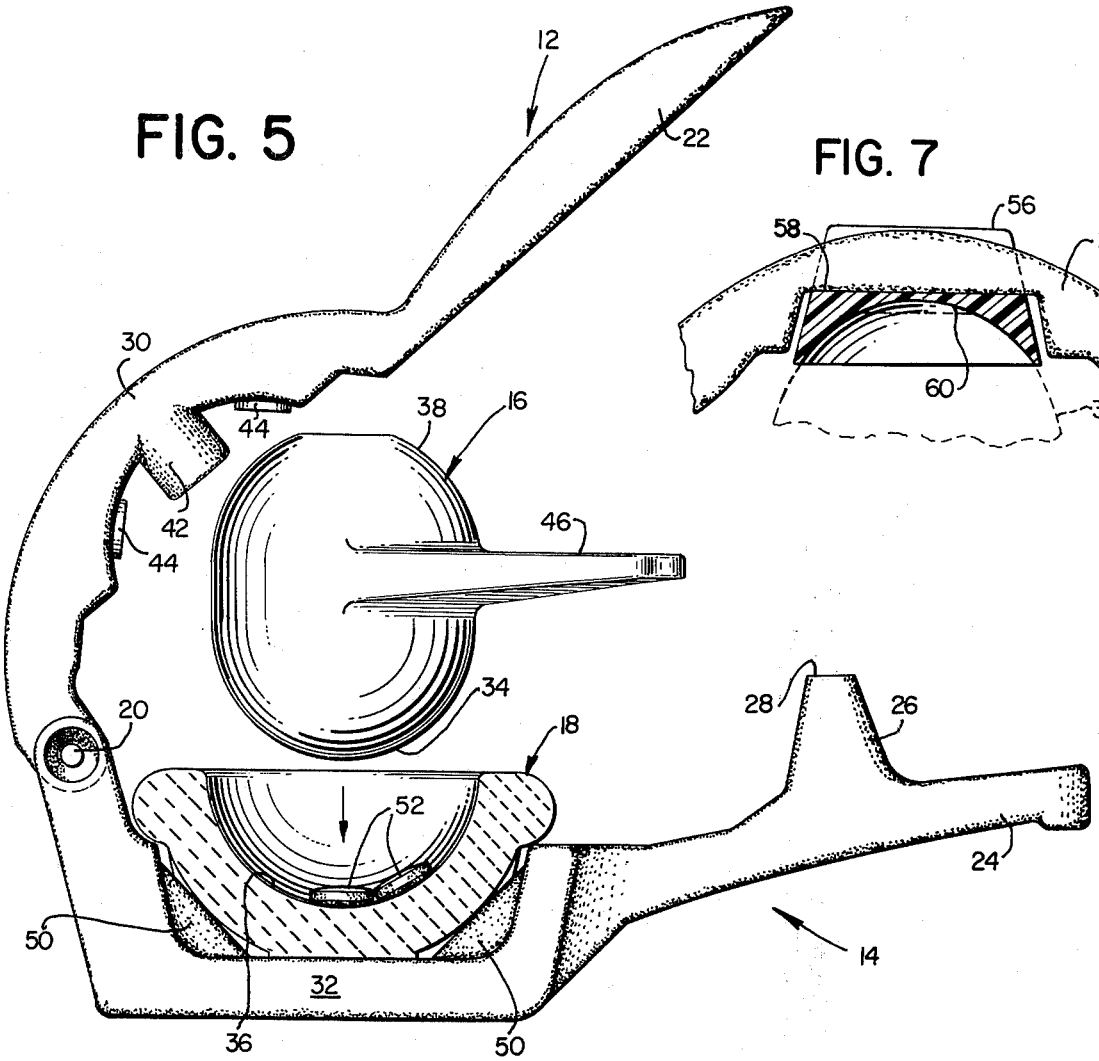
FIG. 5 is a side elevational view similar to FIG. 4 but showing clamping handles in an open position with a pestle unit disassembled from an upper handle.
Figure 6:
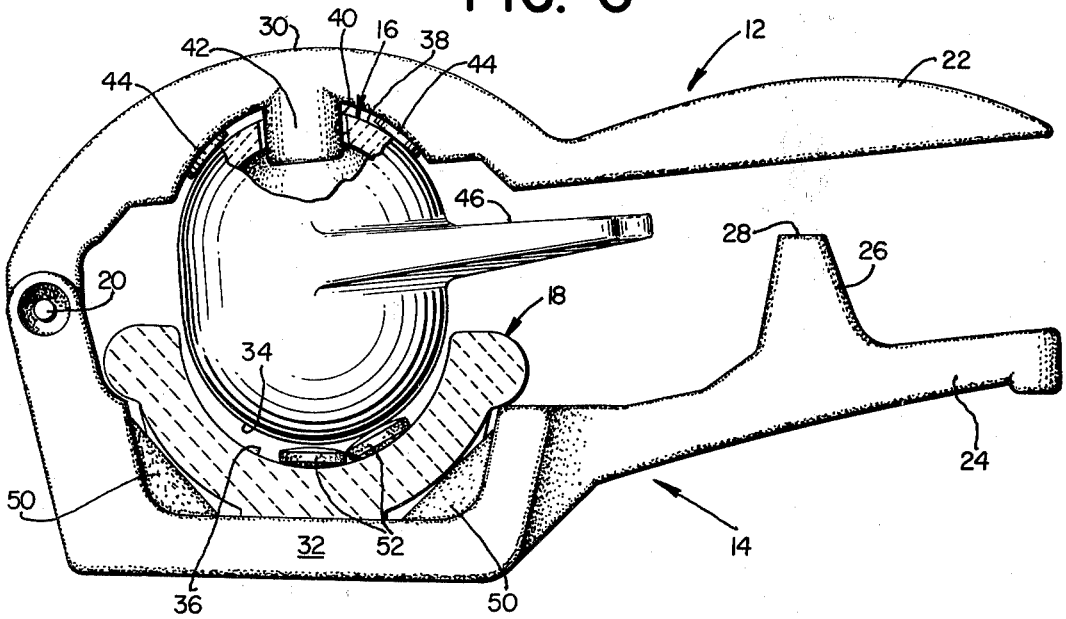
FIG. 6 is a side elevational view similar to FIG. 5 but showing the pill grinder in an operative position about to crush and grind pills in its mortar unit.

Referring now to FIGS. 5 and 6, it will be readily understood that the pestle unit 16 may be raised independently from the mortar unit 18 as shown or, in the alternative, with the lug 42 adapted to hold the pestle unit 16 in place, mere raising of the handle 12 will result in raising of the pestle unit 16. One or more pills may be deposited in the mortar unit 18 as indicated at 52 and the pestle unit 16 and handle 12 may thereupon be lowered to the position shown in FIG. 6. With one hand of the nurse or other operator grasping the handles 12, 14 and applying a squeezing action, the other hand may be employed to grasp the handle 46 and to simultaneously swing the handle and pestle in a back and forth movement whereby simultaneously to crush and rotatably grind the pills. A high degree of ease and efficiency in operation is thus achieved with a relatively simple construction which may be manufactured at economic advantage.

Figure 7:
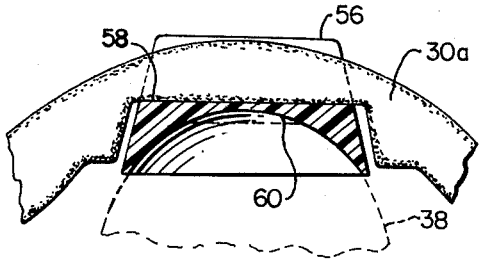
FIG. 7 is a fragmentary side elevational view partially in section and showing an alternative embodiment of a portion of the pill crushing and grinding device.

Referring particularly to FIG. 7, it will be observed that a portion of a handle 30*a* is shown with a slightly different configuration from the handle 30. Rather than the provision of a lug such as 42 in the handle 30, a socket-like element 56 is provided. The element 56 has a slot 58 at an upper portion thereof which receives and fits about an adjacent portion of the handle 30*a* and which is preferably adhesively bonded to the handle. A lower portion of the element 56 is part-spherical in construction to provide a socket 60 for receiving an upper portion of a pestle such as the pestle 38. As will be apparent, a pestle 38 upper portion entered in the socket 60 will be freely rotatable at the urging of the pestle handle 46 to crush and grind pills as described above. In accordance with the presently preferred practice, the element 56 is constructed of a low-friction plastic to provide for the free rotation of an associated pestle.

In FIGS. 8 through 10, a portable pill grinder indicated generally at 10*a* comprises another embodiment of the present invention. The grinder 10*a* has arms 12*a* and 14*a* similar to the arms 12, 14 and which may be of cast aluminum construction. The arms 12*a*, 14*a* are pivotally connected at 20*a* and are separated in the closed position by stop lug 26*a*.

Formed integrally on the arm 12*a* is a pestle 16*a* which is approximately semi-spherical in configuration and which may be of hollow construction for weight reduction. Preferably and as shown, the pestle 16*a* has an outer shell 62 of stainless steel or the like which is fixed thereon by conventional means such as adhesive bonding.

The arm 14*a* in this form of the invention supports a two-part mortar 18*a* beneath and in operative relationship with the pestle 16*a*. A first or lower part 64 of the mortar 18*a* serves to rotatably support a second or upper part 66. As shown the lower part 64 of the mortar is fixedly secured to the arm 14*a* as by adhesive bonding and is provided with a convex and parti-spherical upper surface at 68. The part 64 is preferably constructed of a low-friction plastic to provide for the convenient rotation of the upper part 66 on the parti-spherical surface 68.

The upper part 66 of the mortar 18*a* takes the form of a ladle with a shell-like parti-spherical body 70 and a handle 72. As best illustrated in FIG. 8, the parti-spherical body 70 fits into the cavity formed by the parti-spherical surface 68 and in a pill grinding operation the handle may be swung to and fro with the handles 12*a* and 14*a* squeezed together and the pestle 16*a* entered in the body 70 of the part 66. The crushed or ground pill may thereafter be transported by the nurse as required employing the part 66 as a ladle or spoon, FIG. 10. Preferably the mortar part 66 is of stainless steel construction.

The handle 72 of the part 66 is preferably U-shaped as shown so as to be disposed about the lug 26*a* as shown in FIG. 8 when in a storage position.

I claim:

1. A portable pill crushing and grinding device comprising cooperating mortar and pestle units and manually operable clamping handles for applying pill crushing pressure to said units, said mortar and pestle units respectively having concave and convex pill crushing and grinding surfaces of a smooth, hard and impervious material, said surfaces being complementary and relatively rotatable about a common axis, said mortar being removable from said handles and at least one of said units having a manually engageable rotating handle for effecting such relative rotation, and said one unit being connected with an associated one of said clamping handles for relative rotation whereby said clamping and rotating handles may be grasped respectively in one and opposite hands and simultaneously squeezed together and swung back and forth respectively to apply crushing and grinding pressures on one or more pills disposed between said complementary mortar and pestle surfaces.

2. A portable pill crushing and grinding device as set forth in claim 1 wherein said mortar and pestle units and said clamping handles are separate parts, and wherein said handles are in clamp form with a pivotal connection at adjoining end portions, manually engageable end portions opposite said adjoining portions, and intermediate portions engageable with and supporting said mortar and pestle units.

3. A portable pill crushing and grinding device as set forth in claim 2 wherein a stop is provided between said manually engageable end portions to prevent the exertion of excessive pressure on said mortar and pestle units.

4. A portable pill crushing and grinding device as set forth in claim 2 wherein clamping handles are arranged in upper and lower relationship, and wherein said mortar is removably supported atop said intermediate portion of said lower handle, said handle portion and mortar having inter-engaging surfaces preventing relative rotation therebetween.

5. A portable pill crushing and grinding device as set forth in claim 4 wherein said mortar is provided with at least two downwardly opening, generally radial grooves, and wherein said intermediate handle portion has at least two upwardly projecting flanges adapted respectively to enter said mortar grooves and to retain the mortar against rotation.

6. A portable pill crushing and grinding device as set forth in claim 4 wherein said pestle is removably and rotatably held beneath said intermediate portion of said upper clamping handle and above said mortar, said pestle having an upwardly facing circular opening at an upper portion thereof, and said handle portion having a circular, downwardly projecting lug rotatably entered in said opening.

7. A portable pill crushing and grinding device as set forth in claim 6 wherein said pestle has an integrally formed and laterally projecting handle thereon constituting the aforesaid rotating handle.

8. A portable pill crushing and grinding device as set forth in claim 7 wherein low friction pads are provided on said intermediate portion of said upper handle to engage an upper portion of said pestle and to facilitate relative rotation of said pestle.

9. A portable pill crushing and grinding device as set forth in claim 2 wherein said mortar and pestle units are of ceramic construction.

10. A portable pill crushing and grinding device as set forth in claim 2 wherein said mortar and pestle units are of stainless steel construction.

11. A portable pill crushing and grinding device as set forth in claim 4 wherein said pestle is removably and rotatably held beneath said intermediate portion of said upper clamping handle and above said mortar, said pestle having a parti-spherical upper portion, and said handle portion being provided with a socket element of a low-friction material and which includes a downwardly facing parti-spherical socket for rotatably receiving said upper pestle portion.

12. A portable pill crushing and grinding device as set forth in claim 11 wherein said pestle has an integrally formed and laterally projecting handle thereon constituting the aforesaid rotating handle.

13. A portable pill crushing and grinding device as set forth in claim 1 wherein said mortar is of two-part construction with a lower part mounted on a lower handle and serving a base and supporting function and an upper part being rotatable thereon and removable therefrom, said upper part also having a handle for ease and convenience in rotation and transportation.

14. A portable pill crushing and grinding device as set forth in claim 13 wherein said pestle and said upper mortar part have stainless steel surfaces facing each other and engageable for the crushing and grinding of pills.

15. A portable pill crushing and grinding device as set forth in claim 13 wherein said upper mortar part is of shell-like stainless steel construction.

16. A portable pill crushing and grinding device as set forth in claim 15 wherein said lower mortar part is constructed of a low-friction plastic.

17. A portable pill crushing and grinding device as set forth in claim 16 wherein said pestle is formed integrally on an upper handle of said device and provided with a stainless steel covering member engageable with the mortar upper part.

* * * * *